US011473409B2

(12) United States Patent
Al-Mousa et al.

(10) Patent No.: US 11,473,409 B2
(45) Date of Patent: Oct. 18, 2022

(54) CONTINUOUS CIRCULATION AND ROTATION FOR LINER DEPLOYMENT TO PREVENT STUCK

(71) Applicant: SAUDI ARABIAN OIL COMPANY, Dhahran (SA)

(72) Inventors: Ahmed A. Al-Mousa, Dhahran (SA); Qadir Looni, Baluchistan (PK)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 140 days.

(21) Appl. No.: 16/938,046

(22) Filed: Jul. 24, 2020

(65) Prior Publication Data

US 2022/0025742 A1 Jan. 27, 2022

(51) Int. Cl.

| | |
|---|---|
| ***E21B 43/10*** | (2006.01) |
| ***E21B 4/02*** | (2006.01) |
| ***E21B 21/01*** | (2006.01) |

(52) U.S. Cl.

CPC ..... *E21B 43/103* (2013.01); *E21B 4/02* (2013.01); *E21B 21/01* (2013.01); *E21B 43/10* (2013.01)

(58) Field of Classification Search

CPC ..... E21B 43/103; E21B 43/10; E21B 4/02; E21B 21/01

See application file for complete search history.

(56) References Cited

U.S. PATENT DOCUMENTS

| | | | | |
|---|---|---|---|---|
| 6,374,838 | B1 * | 4/2002 | Baugh | B08B 9/0551 134/167 C |
| 7,784,552 | B2 | 8/2010 | Brouse | |
| 7,926,578 | B2 | 4/2011 | Moffitt et al. | |
| 8,607,859 | B2 * | 12/2013 | Eriksen | E21B 7/20 175/171 |
| 9,027,673 | B2 | 5/2015 | Vail, III et al. | |
| 10,260,295 | B2 * | 4/2019 | Zhou | E21B 25/00 |
| 2005/0126826 | A1 | 6/2005 | Moriarty et al. | |
| 2005/0284633 | A1 | 12/2005 | Richard | |
| 2006/0283636 | A1 * | 12/2006 | Reagan | E21B 4/02 175/320 |
| 2007/0284106 | A1 * | 12/2007 | Kalman | E21B 34/02 166/308.1 |
| 2011/0005834 | A1 * | 1/2011 | Crawford | E21B 21/103 175/48 |
| 2014/0158432 | A1 | 6/2014 | Simpson | |
| 2014/0326454 | A1 | 11/2014 | Giroux et al. | |

FOREIGN PATENT DOCUMENTS

| | | | |
|---|---|---|---|
| WO | 2004072434 | A2 | 8/2004 |
| WO | 2014081417 | A1 | 5/2014 |

OTHER PUBLICATIONS

International Search Report and Written Opinion issued in Application No. PCT/US2020/050668, dated Mar. 29, 2021 (11 pages).

* cited by examiner

*Primary Examiner* — Yong-Suk (Philip) Ro

(74) *Attorney, Agent, or Firm* — Osha Bergman Watanabe & Burton LLP

(57) ABSTRACT

A system for drilling a well includes a gripping unit provided at a rig above a surface of the well for holding a top end of a drill string in the well, a liner releasably connected to the drill string, and a downhole motor installed on the drill string in an axial position between the surface of the well and the liner, where the downhole motor has a stator connected to the drill string and a rotor operatively connected to an axial end of the liner closest to the surface of the well.

22 Claims, 11 Drawing Sheets

CONTINUOUS CIRCULATION AND ROTATION FOR LINER DEPLOYMENT TO PREVENT STUCK

BACKGROUND

A well for extracting a natural resource from underground may be formed by drilling a borehole to a certain depth and then cementing casing within the borehole. Casing having successively smaller diameters may be installed through previously installed casing as the borehole is drilled deeper, where each string of casing hangs from the surface wellhead assembly to different depths in the well.

In some wells, a liner may be run into a borehole below installed casing and cemented in place to continue the depth of the well. Like strings of casing, a liner is made of connected-together joints of pipe. However, instead of being secured to the surface wellhead assembly as casing string is, liners are secured to the lowermost end of the casing in the well.

A liner may be installed downhole using a running tool connected to a drill string that is sent downhole. Further, liner may be sent downhole with the drill string during drilling, where a drill bit and liner string are connected together and rotate together during drilling, or where the drill bit is rotated independently of the liner string by a downhole motor provided as part of the bottom hole assembly.

Upon moving the liner into position downhole, an upper end of the liner is connected to the lowermost end of the casing. A certain amount of cement may then be pumped through the drill string and to the bottom of the liner, where it exits the liner and flows upward around the annulus between the liner and borehole wall to cement the liner in place. After cementing, the drill string may be cleaned out, for example, by pumping fluid through the drill string.

FIG. 1 shows an example of a subsea well having a riser 10 extending to a wellhead assembly 12 at the sea floor 14. The wellhead assembly 12 includes an outer wellhead housing 11 and an inner wellhead housing 13. Casing strings 15 are hung from the wellhead assembly 12 and cemented around the borehole wall 16. A liner 18 is secured to the lowermost end of the casing 15 with a liner hanger 17 and extends a depth into the borehole from the end of the casing 15. The annulus between the borehole wall 16 and the liner 18 may be filled with cement 19 to cement the liner 18 in place. Drill string 20 may run through the casing 15 and liner 18 to continue downhole operations.

During drilling operations, as the bottom hole assembly (including drill bit) drills farther into the earth, additional sections of drill pipe, often referred to as drill pipe stands, are added to the top of the drill string at the rig surface. To add additional stands of drill pipe, rotation of the drill string is stopped while the new drill pipe section is connected. In many operations, continuous circulation systems may be used to continue circulation of drilling fluid through the drill string while the drill string is stationary and new drill pipe is being connected in order to prevent the settling of drill cuttings and prevent equipment stick.

SUMMARY

In one aspect, embodiments of the present disclosure relate to systems for drilling a well that include a gripping unit provided at a rig above a surface of the well for holding a top end of a drill string in the well, a liner releasably connected to the drill string, and a downhole motor installed on the drill string in an axial position between the surface of the well and the liner, where the downhole motor has a stator connected to the drill string and a rotor operatively connected to an axial end of the liner closest to the surface of the well.

In another aspect, embodiments of the present disclosure relate to methods that include tripping a drill string into a well, where the drill string has a downhole motor connected between a lower end of the drill string opposite a surface of the well and a liner, where the liner is operatively connected to a rotor of the downhole motor. Methods may further include connecting a drill pipe stand at an upper end of the drill string, rotating the liner relative to the drill string using the downhole motor during the connecting, and continuously pumping a fluid through the drill string during the connecting.

In yet another aspect, embodiments of the present disclosure relate to systems including a drill string made of a plurality of connected-together drill pipe and at least one continuous circulation sub, a liner disposed at a lower end of the drill string, a downhole motor operatively connecting the liner to the drill string, and continuous circulation piping fluidly connected to a fluid source and at least one pump.

Other aspects and advantages of the invention will be apparent from the following description and the appended claims.

DETAILED DESCRIPTION

Embodiments of the present disclosure generally relate to systems and methods for continuously rotating a downhole liner in an open hole while making drill pipe connections. Embodiments may include a continuous circulation system to continuously pump fluid downhole and one or more downhole motors to continuously rotate a downhole liner being installed while drill string connections are made at a rig above the well.

As used herein, the terms "top," "upper," "uppermost," "above," and the like may be used to refer to a direction facing the surface of a well (e.g., a wellhead) from a downhole position, while the terms "bottom," "lower," "lowermost," "below," and the like may be used to refer to a direction facing away from the surface of the well toward the bottom of the wellbore from a downhole position.

According to embodiments of the present disclosure, as a wellbore is drilled and completed, a liner may be used to case at least one section of the well. A liner may be sent downhole through a previously cased portion of a well to an open hole section of the well to line and case the borehole.

The liner may be installed by attaching the liner to an already installed casing in the well and pumping cement through the liner and into the annulus formed between the liner and borehole wall. The liner may be run into the well using, for example, a running tool that may detach from the liner assembly once the liner is installed.

Figure 1:
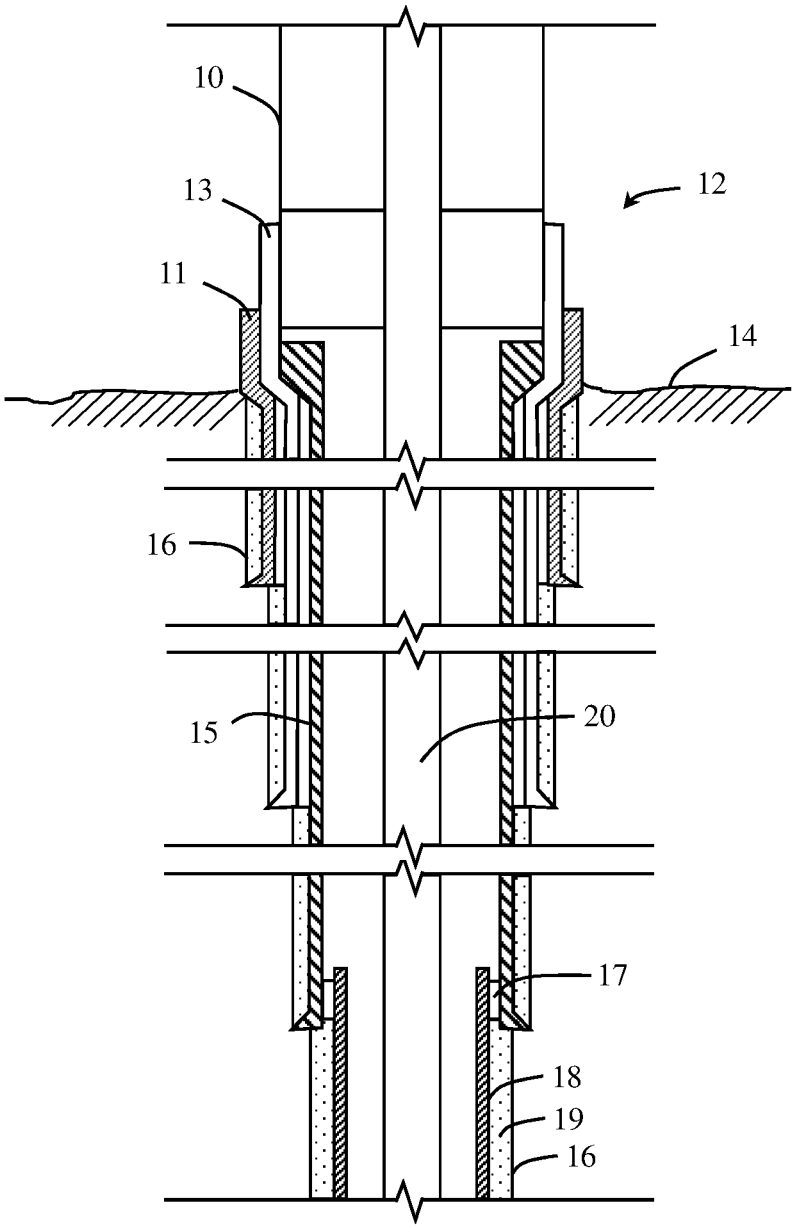
FIG. 1 (Prior Art)
FIG. 1 shows a cross-sectional view of a conventionally formed well having casing hung from the wellhead and a liner hung from the casing.
Figure 2:
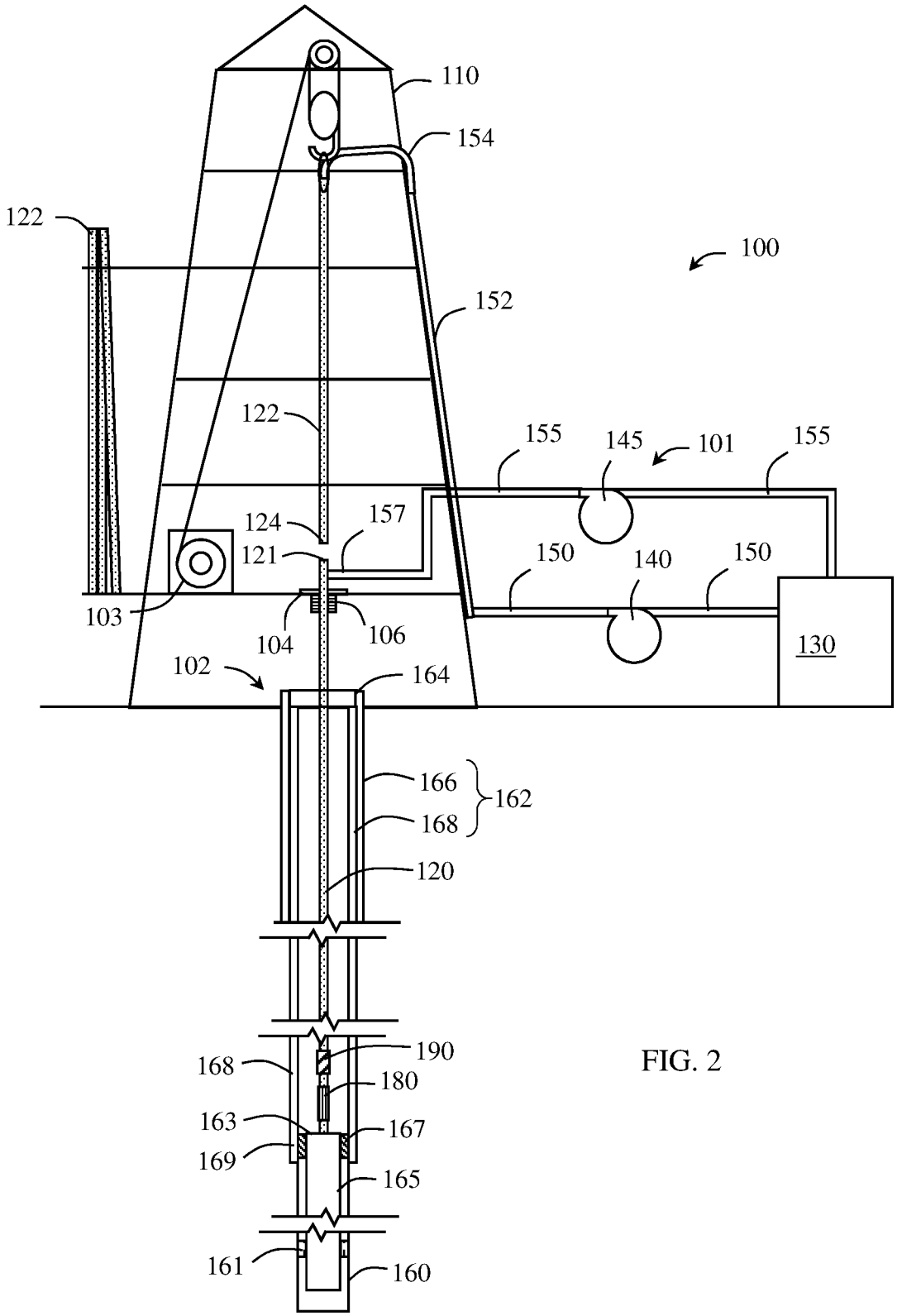
FIG. 2 shows a system for lining a well according to embodiments of the present disclosure.

FIG. 2 shows an example of a drilling system according to embodiments of the present disclosure. The drilling system 100 may be set up around one or more wells 102 and include drilling equipment used for drilling and completing the well 102. When drilling on land, as shown in FIG. 2, a rig 110 may be positioned over the well 102 to hold and operate the drilling equipment. When drilling subsea wells, a rig may be built on a platform floating over the well at the sea floor, where one or more risers fluidly connects the well to the rig platform. Drilling equipment may include, but is not limited to, a drill string 120 (a connected-together length of drill pipe, a bottomhole assembly and any other tools used to make the drill bit turn that is lowered into the wellbore); a top drive or a Kelly and rotary table system 104 used to rotate the drill string 120; a drawworks 103 (e.g., a winch and cable-pully system) or other device that may be used to pick up and align additional joints of drill pipe 122 to be connected to the drill string 120; slips 106 (e.g., gripping wedges having a plurality of gripping elements such as steel teeth) used to hold the drill string 120 in place while drill pipe is added or removed; one or more fluid sources 130 (e.g., a drilling fluid (or mud) tank or cement tanks); one or more pumps 140 fluidly connected to the fluid source(s) 130; and flowlines 150 (e.g., including standpipe(s) 152 and high pressure hose(s) 154) fluidly connecting and extending from the fluid source(s) 130 to the pump(s) and toward the top of the rig 110 that may be connected to a top end of the drill string 120.

When making a connection to the drill string 120, additional drill pipe 122 may be connected to a top end 121 of the drill string 120. Prior to connecting to the drill string 120, additional joints of drill pipe 122 may be connected together, for example, in lengths of 2 to 4 drill pipe joints, to form a drill pipe stand, where the drill string 120 may be added to by connecting a drill pipe stand 122 at the top end of the drill string 120. In some embodiments, a drill pipe stand 122 to be added to a drill string 120 may be a single drill pipe joint. Rotation of the drill string 120 is stopped, and the slips 106 are set around the drill string 120 to suspend the top end 121 of the drill string just above the rig floor. The next drill pipe stand 122 is then moved above and substantially axially aligned with the drill string 120 (e.g., using drawworks 103 or one or more mechanical arms) and then lowered to connect the lower end 124 of the drill pipe stand 122 to the top end 121 of the drill string 120. The drill pipes may be connected together by threaded connections (e.g., a threaded pin end of one drill pipe inserted and threaded into a box end of another drill pipe) and/or using additional connecting element such as a clamp and/or intermediate threaded connections. One or more steps in making a drill string connection may be automated, for example, using robotic arms to maneuver equipment, or may be done manually.

Once a next drill pipe stand 122 is connected to the drill string 120, the slips 106 may be removed, rotation of the drill string 120 from the rig 110 may be resumed, and the drill string 120 may continue to be sent downhole. The process of adding drill pipe to the drill string 120 may be repeated until a desired depth into the earth is reached.

As certain depths of drilling a borehole 160 is achieved, the borehole 160 is cased with casing 162 that extends from a wellhead 164 to a depth into the borehole 160. The casing 162 may be made of connected together pipe (e.g., steel pipe) that is cemented into the borehole 160. When casing 162 is installed in a borehole, the cased section of the well may have an inner diameter formed by the casing 162 and a layer of cement between the casing 162 and the formation. As used herein, the terms borehole 160 and wellbore synonymously refer to the drilled hole, including the openhole or uncased portion of the well, where the inside diameter of the borehole wall is the rock face that bounds the drilled hole. A well may be cased with progressively smaller diameter casings (e.g., an outer casing 166 and inner casing 168), where smaller diameter casing 168 is lowered through and set within larger diameter casing 166.

When a depth drilled is to go farther than a casing 162 extending from the wellhead 164, a type of casing called a liner 165 may be sent downhole to case an open section of borehole 160. A liner 165 refers to a casing string that, when installed, does not extend to the top of the wellbore or wellhead 164. Thus, casing and liner strings may be formed of the same material but installed in different locations in a well. Further, the liner may have an outer diameter smaller than the inner diameter of the casing, such that the liner may fit through the casing. A plurality of individual liner pipes (or joints) may be connected together to form a liner string. As used herein, the terms "liner" and "liner string" may be used interchangeably. When installed, liners 165 are anchored to the bottom of the previously installed casing string 168. The previously installed casing could be another liner string or could be a casing string extending to the top of the wellbore. The liner 165 may be an inner string of pipe having a smaller outer diameter than the inner diameter of a larger diameter pipe already set within the well, such that the liner 165 may fit through the already cased portion of the well.

When assembling and installing the liner 165, a first length of liner joint to be assembled, which will be positioned as the bottom of the liner string, may be a float joint. A float joint may have cement plugging the bottom of the liner joint, or may have a float valve, to prevent reverse flow of cement back into the casing after placement. In some cases, more than one liner joint assembled as the bottom of the liner string may have float joint components, such as a float collar, a float valve, a float shoe, cement filling, one or more plugs, and/or a landing collar. In a similar manner to assembling drill string, the first liner joint(s) (forming the base of the liner string) may be held above the well by slips or other gripping device on the rig. While the slips are holding the first liner joint, a second liner joint may be positioned axially over the first liner joint and connected in an end-to-end manner, where the axial ends of the liner joints may be threaded together, for example, using a threaded casing collar. Third, fourth, and so forth liner joints may be connected together and sent downhole until a desired length of liner string is achieved.

At the top end 163 of the liner 165, a liner hanger 167 may be attached around or integrally built into the liner joint for eventual attachment of the liner 165 to another casing 168. The top end 163 of the liner 165 having the liner hanger 167 may be referred to as a liner hanger joint. The liner 165 may be attached to a previously installed casing 168 using the liner hanger 167, for example, by actuating one or more gripping elements in the liner hanger 167 to expand radially outward from the liner hanger 167 body to engage and grip the inner diameter of the casing 168.

According to embodiments of the present disclosure, a liner hanger may include at least one set of slips with gripping elements, which may grip an interior surface of the outer previously installed casing. The slips may be radially expanded to grip the interior of the outer casing, for example, by mechanical or hydraulic actuation. Slip assemblies on a liner hanger may be long, extending a majority of the axial length of the liner hanger or multiple slip assemblies may be positioned along the axial length of the liner hanger (e.g., two or three rows of slip assemblies).

In some embodiments, a rotatable liner hanger may be used to attach the top end 163 of a liner 165 to a bottom end 169 of previously installed casing 168. A rotatable liner hanger may include at least one slip or other type of gripping member provided around a liner hanger body and a rotatable element, wherein the rotatable element is rotatable relative to the liner hanger body. A gripping slip may be activated to extend radially outward from the liner hanger body into the previously installed casing 168 (to grip the liner string to the previously installed casing). A rotating component may be connected (e.g., directly or indirectly through one or more connectors) to the liner 165 and may rotate the liner string relative to the previously installed casing 168. A rotating component of a rotatably liner hanger may be a bearing assembly including a bearing (e.g., ball bearings or bearing surface) between the bearing assembly and a relatively stationary liner hanger body. In embodiments using a rotatable liner hanger to attach the liner 165 to previously installed casing 168 downhole, the liner 165 may be rotated via the rotatable liner hanger during a cementing process (pumping cement through the liner and out the bottom of the liner to the annulus between the liner and open borehole wall), which may improve the flow of cement around the annulus, and thus coverage and integrity of the cement.

According to some embodiments, a liner 165 may further have one or more centralizers 161 disposed around the outer diameter of the liner. A centralizer 161 may be an annular body disposed around and protruding a uniform distance from the outer diameter of the liner 165 to keep the liner centralized within the well as it is installed.

Upon assembling the liner 165, from the first liner joint (e.g., a float joint or shoe) to the last liner joint (e.g., the liner hanger joint) of the liner 165, a running tool 180 may be attached to the liner hanger joint at the top end 163 of the liner 165. In some embodiments, one or more of a spacer sub and a connecting sub may be connected between the top end 163 of the liner 165 and the running tool 180. In some embodiments, a running tool 180 may be directly connected to (and contacting) the top end 163 of the liner 165. In some embodiments, a bottom end of the running tool 180 (which may be referred to as a liner connection end of the running tool 180) may be connected to the top end 163 of the liner 165 with a pressure release mechanism. In the oil and gas industry, a running tool may also be referred to as a setting tool. Different types of running tools 180 may be used to hold/attach the liner 165 to the drill string 120 as it is sent in position downhole and to release the liner 165 after it has been attached to a previously installed casing 168.

Examples of suitable running tools may include a generally tubular body having a liner connection end at one axial end of the running tool that connects to the liner hanger joint and a drill string connection end at the opposite axial end of the running tool that connects to the drill string. The liner connection end may be threadedly connected to the liner hanger joint and/or may have one or more shearing elements that connect the running tool to the liner hanger joint and that may be sheared to release the running tool from the liner hanger joint. When using a threaded connection between the running tool and the liner hanger joint, the threads may be designed to require less torque for release rotation than that of the threaded connections used in connecting the drill string joints. In some embodiments, the connection between the liner connection end of the running tool and the liner hanger joint may have other types of mechanical releasable attachments, such as J-slots and ball drop released locking members (where a ball or dart is dropped through the drill string into a landing seat to block a through-hole, such that when fluid is pumped through the drill string, a locking member(s) is released).

Above the running tool 180, a downhole motor 190 may be connected either directly to the running tool 180 or indirectly via one or more connecting joints. For example, a rotatable component of the downhole motor 190 may be connected to a top end of the running tool (which may be referred to as a motor connection end of the running tool 180) by a threaded connection. In some embodiments, components of a running tool liner connection end (e.g., pressure release mechanism(s), a threaded connection end, a J-slot configurations, and/or one or more shearing elements) may be integrated with a downhole motor 190, such that a separate running tool 180 is not needed to releasably connect the downhole motor 190 to the liner 165.

A plurality of drill string 120 joints may then be connected in an end-to-end manner, as described above, from the downhole motor 190 until the drill string 120 reaches a length that positions the liner hanger 167 at the bottom end 169 of the previously installed casing 168 for attachment of the liner 165 to the previously installed casing 168. In such manner, the liner 165 may be connected to a lower end of the drill string 120 through the running tool 180 and the downhole motor 190. Further, the liner 165 may be releasably connected to the drill string 120 through the running tool 180 (or other releasable connection located between the downhole motor 190 and the liner 165), such that when the liner 165 is positioned in a desired location downhole, the liner 165 may be released from the drill string 120.

As each joint of drill string 120 is added, rotation of the already connected components (including already connected drill string 120 joints, the downhole motor 190, the running tool 180, and the liner 165) from the rig (e.g., from the Kelly and rotary table system or top drive system) will be stopped in order to make the drill pipe connection. When rotation from the rig is stopped to make a connection, the downhole motor 190 may be used to rotate the connected-together components below the downhole motor 190, including the liner 165.

For example, the downhole motor 190 may be operatively connected to the liner 165 through a running tool 180, where the running tool 180 is detachably connected to a top end 163 of the liner 165. The downhole motor 190 may rotate the running tool 180, which in turn, rotates the connected liner 165. When the running tool 180 is detached from the liner 165, the downhole motor 190 may no longer be used to rotate the liner 165.

According to embodiments of the present disclosure, a downhole motor 190 may be a positive displacement motor. A positive displacement motor may operate by moving fluid through the motor. An example of a positive displacement motor that may be used includes Moineau motors or progressive cavity positive displacement motors (sometimes referred to as mud motors) that may be connected as part of the drill string 120 between axially adjacent joints (e.g., where one axial end of the motor 190 may be connected to the running tool 180 or directly to a liner 165, and an opposite axial end of the motor may be connected to a drill pipe in the drill string 120). A downhole progressive cavity positive displacement motor 190 may have a substantially tubular body with a helical-shaped rotor extending axially through the body. The interior of the body may have a plurality of lobed grooves (e.g., integrally formed within the inner surface of the body or formed in an interior lining positioned within the body) in which the helical rotor blades may rotate within. A fluid inlet (including one or more openings) may be at an upper axial end of the motor 190 and a fluid outlet (including one or more openings) may be at a lower axial end of the motor 190. When fluid (e.g., drilling fluid) is pumped through the drill string 120 and into the fluid inlet of the motor 190, the fluid may rotate the helical-shaped rotor relative to the stationary motor body (stator). The fluid may exit the motor 190 through the fluid outlet and be sent farther downhole and/or back to the surface of the well through an annulus around the drill string 120.

The rotor component of the downhole motor 190 may be connected to the liner 165 (e.g., via connection through the running tool 180), which rotates the liner 165 as fluid is pumped through the motor 190.

According to embodiments of the present disclosure, fluid may be continuously pumped downhole to the downhole motor 190 while a connection is being made at the rig using a continuous circulation system 101. A continuous circulation system 101 may include a fluid source 130 (which may be the same as or different than the fluid source used for pumping fluid through the top of the drill string), at least one mud pump 145, and continuous circulation surface piping 155 (which may include one or more pipes or hoses) fluidly connected to the at least one mud pump 145. The continuous circulation surface piping 155 may include an injection end 157 that may be connected to the top end 121 of the drill string 120. For example, the injection end 157 may be a nozzle that is inserted into a side inlet at the top end 121 of the drill string 120 to pump fluid into the drill string 120 while a connection is being made to the top end 121 of the drill string. In some embodiments, a continuous circulation system may include a housing at the injection end 157 that may surround both the top end 121 of the drill string 120 and a bottom end of the drill pipe stand 122 to be connected, where a series of valves selectively allow fluid flow between the top end and the continuous circulation system during making a connection.

When a connection to the drill string 120 is made (to lengthen the drill string 120 and send the attached liner 165 farther downhole), rotation of the drill string 120 from the rig is stopped, fluid flow from the continuous circulation system 101 is directed through the drill string 120 while fluid flow through the drill string from the top end (e.g., through upper flowline 154) is stopped, and the lower end 124 of the next drill pipe stand 122 is connected to the top end 121 of the drill string 120. By using the continuous circulation system 101 to continuously deliver fluid flow through the drill string 120 while a connection is being made, the fluid flow may power the downhole motor 190 to continuously rotate the liner 165 as the connection is being made.

When the liner 165 is in the desired location downhole, the liner hanger 167 may be actuated to attach the top end 163 of the liner 165 to the bottom end 169 of the farthest-extending installed casing 168. After hanging the liner 165, the liner 165 may be cemented within the wellbore 160 by circulating cement downhole through the interior of the liner 165 and upwardly about the exterior of the liner 165 to fill the annulus with cement. After cementing the liner 165 in place, the running tool 180 may be disconnected from the liner 165, and the drill string 120 may be brought back up to the surface of the well.

Figure 3:
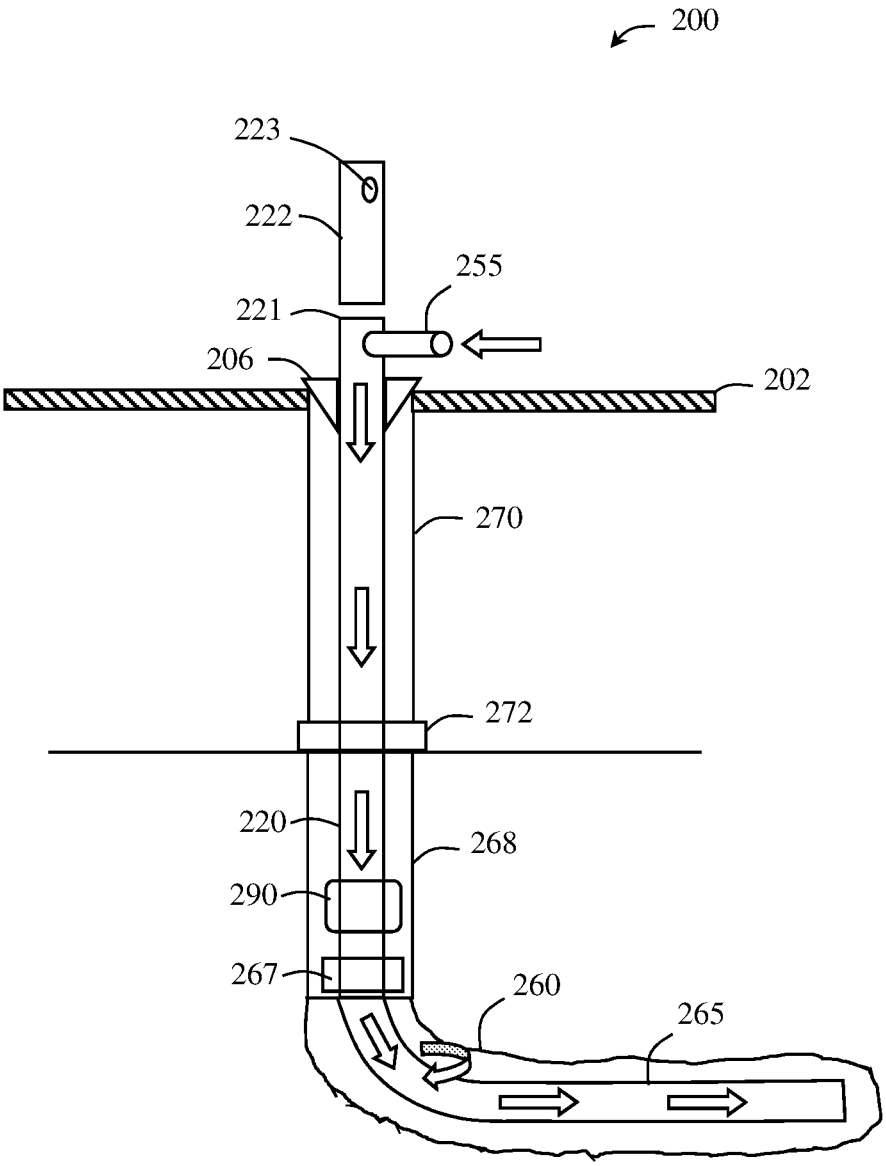
FIG. 3 shows a system for lining a well according to embodiments of the present disclosure.

Systems using a downhole motor to continuously rotate a liner as it is sent downhole to be set within a borehole may be used in vertical drilling or directional drilling. For example, FIG. 3 shows a system 200 according to embodiments of the present disclosure for directional drilling. FIG. 3 also shows an example of the system 200 in use for a subsea well, where a riser 270 extends from the surface of the well 272 to the rig 202, and drill string 220 is sent through the riser 270 into the well 272.

The system 200 may include a gripping unit 206 (e.g., one or more slip assemblies, clamps, robotic arms, etc.) provided at the rig floor 202, above the surface of the well 272, for holding a top end 221 of a drill string 220 in the well as a connection to the drill string is made. A continuous circulation system may also be provided at or near the rig 202 to continuously pump fluid (e.g., drilling fluid or mud) down the drill string 220 as a connection is being made, where the continuous fluid flow may be used to rotate a liner 265 connected to the drill string. For example, in the system 200 shown in FIG. 3, the continuous circulation system may include continuous circulation surface piping 255 fluidly connected to at least one mud pump (not shown) and fluid source (not shown), e.g., a mud pit, which may provide continuous fluid flow through the drill string 220 when attached to the drill string 220.

The continuous circulation surface piping 255 may have an injection end that connects to a top end 221 of the drill pipe being connected. In the embodiment shown, the top end 221 of the drill string 220 may be formed of a continuous circulation sub having a valved side inlet. The injection end of the continuous circulation surface piping 255 may be connected to the continuous circulation sub and inject fluid through the valved side inlet and into the drill string 220 while a next drill pipe stand 222 is being connected to the top end 221 of the drill string 220. The next drill pipe stand 222 may also have a continuous circulation sub with a valved side inlet 223 forming the top end of the drill pipe stand 222. In such manner, after the next drill pipe stand 222 is attached to the drill string 220, becoming a part of the drill string 220, and lowered into the well, the valved side inlet 223 may be used to have fluid injected through the continuous circulation surface piping 255 as yet another connection is made.

The system 200 may also include a downhole motor 290 installed on the drill string 220 proximate to the liner 265, where a rotatable component of the downhole motor 290 is operatively connected to the liner 265. When connections to the drill string 220 are made, and an upper end of the drill string 220 (relatively closer to the rig than the liner) is held stationary to make the connection, the downhole motor 290 may continuously rotate the liner 265 to prevent liner sticking.

According to some embodiments of the present disclosure, a liner 265 may have a rotatable liner hanger 267 sub forming the top end of the liner string. When the drill string 220 is attached to the liner 265, the rotatable liner hanger 267 and the downhole motor 290 may be proximate to each other (e.g., directly contacting or separated by 1 or 2 connection joints). The rotatable liner hanger 267 may be used to attach and hang the liner 265 from an already installed casing 268 (e.g., a casing or liner cemented into the borehole) in the well while also allowing the liner 265 to rotate relative to the casing 268. For example, a rotatable liner hanger 267 may have a rotatable element connected to the liner 265 and a liner hanger body with at least one gripping element capable of radially expanding and gripping the casing 268, where the rotatable element is rotatable relative to the liner hanger body.

After the liner 265 is attached to the installed casing 268 (e.g., via gripping elements around a liner hanger body), cement may be pumped through the interior of the drill string 220, through the interior of the liner 265, and around the exterior of the liner 265 between an annulus formed between the liner 265 and the open borehole 260 wall. Cement flow through the drill string 220/liner 265 assembly may activate rotation of a rotatable component in the rotatable liner hanger 267, such that rotation of the rotatable component also rotates the attached liner 265. In this manner, the liner 265 may be rotated as cement is being pumped through the rotatable liner hanger 267 and into the liner 265.

In some embodiments, the rotatable element in a rotatable liner hanger 267 may be connected to a rotor element in the downhole motor 290, such that rotation from the downhole motor 290 may translate into rotation of the rotatable element in the rotatable liner hanger 267, which may also translate into rotation of the attached liner 265. In some embodiments, the rotatable element in a rotatable liner hanger 267 may rotate independently from the downhole motor 290.

Figure 4:
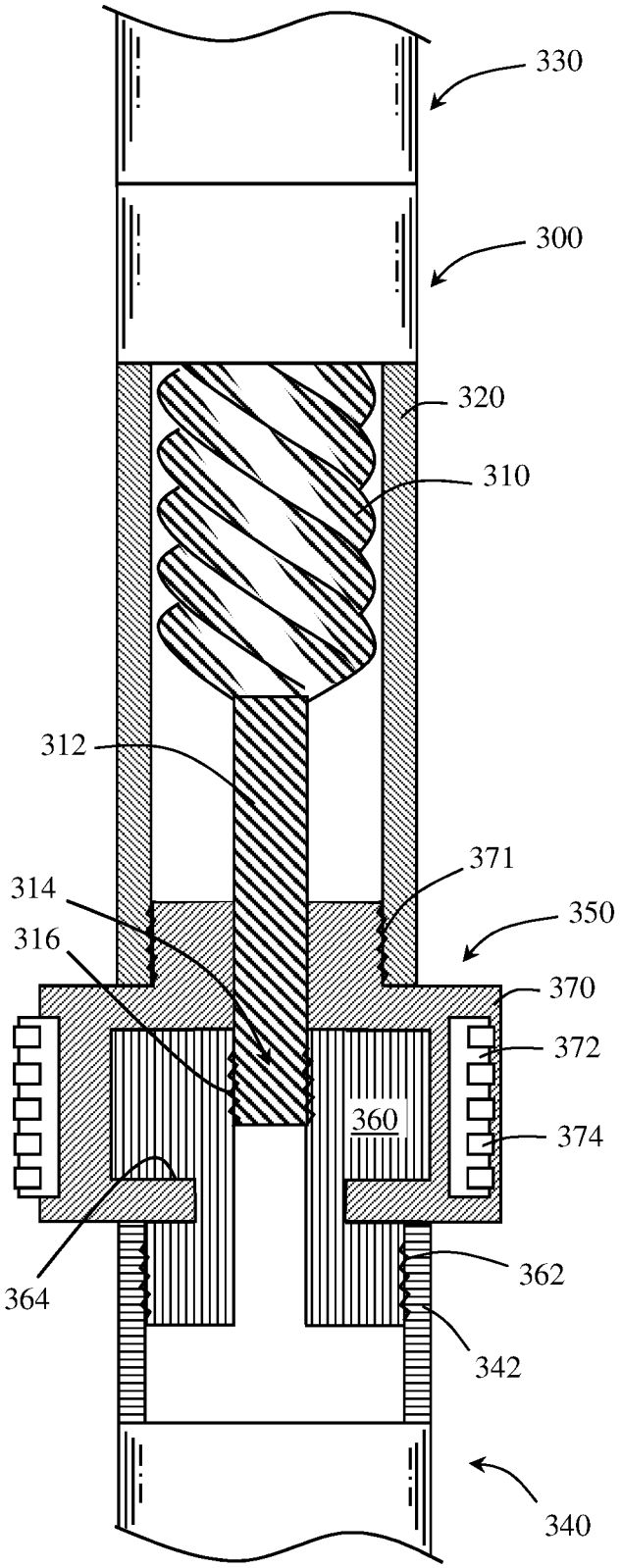
FIG. 4 shows a partial cross-sectional view of a connection between a downhole motor and a liner hanger on a liner according to embodiments of the present disclosure.

FIG. 4 shows a simplified example of a connection between a downhole motor 300 and a rotatable liner hanger 350. The downhole motor 300 is a positive displacement motor having a multi-lobed rotor 310 (e.g., blades or lobes extending helically along a length of the longitudinal axis, as shown in FIG. 4, or a plurality of propeller blades extending outwardly from the longitudinal axis) and a stator 320. The stator 320 may be the housing (tubular outer wall) of the downhole motor 300, such as shown in FIG. 4, or the stator 320 may be attached along the inner surface of the downhole motor housing. The stator 320 may have grooves or recesses formed along its inner surface that allows the rotor 310 to rotate therein.

A transmission shaft 312 may be connected to or integrally formed with the rotor 310 and extend an axial distance from the rotor 310. At an opposite axial end from the rotor 310, a connection end 314 of the transmission shaft 312 may be connected to a rotatable element 360 in the rotatable liner hanger 350. The connection 316 between the transmission shaft 312 and rotatable element 360 may include, for example, a threaded connection, a J-hook, one or more shearable elements, and/or one or more mechanical locking elements. In some embodiments, the connection between the transmission shaft 312 and the rotatable element 360 may be indirect, where one or more additional components are connected between the transmission shaft 312 and the rotatable element 360. The connection 316 (either direct or indirect) between the transmission shaft 312 and the rotatable element 360 may be designed to transmit torque from the rotor 310 to the rotatable element 312. Further, in some embodiments, the connection 316 may also be designed to be disconnected or broken (e.g., after installation of a liner 340 connected to the rotatable liner hanger 350).

The rotatable element 360 in the rotatable liner hanger 350 may be attached to the liner 340, for example, by a threaded connection 362. Further, one or more bearings 364 (e.g., bearing surfaces and/or ball bearings) may be provided between the rotatable element 360 and an outer liner hanger body 370 of the rotatable liner hanger 350, where the bearings 364 may be designed to both axially retain the rotatable element 360 within the liner hanger body 370 and allow rotation of the rotatable element 360 relative to the liner hanger body 370.

The stator 320 portion of the downhole motor 300 may be directly or indirectly connected to a drill string 330 (e.g., by a threaded connection between an end drill pipe of the drill string and the downhole motor housing 320) at one axial end of the downhole motor 300, and at the opposite axial end, the stator 320 portion of the downhole motor 300 may be directly or indirectly connected to the liner hanger body 370. In the embodiment shown, the downhole motor 300 is directly connected to the liner hanger body 370 by a threaded connection 371. Although, additional or alternative connection types may be used, such as J-locks, mechanical locking mechanisms, and/or shearable pins. In some embodiments, a running tool may be connected between the downhole motor 300 and the liner hanger body 370. In either direct or indirect arrangement, the connection 371 between the downhole motor 300 and the liner hanger body 370 may be designed to be disconnected (e.g., shearable connections sheared, locking mechanisms released, threaded connections unthreaded), such that after installation of liner 340, the downhole motor 300 may be removed.

The liner hanger body 370 may include a plurality of gripping slips 372 that may be actuated to expand radially outward to contact and grip a casing inner surface. The gripping slips 372 may include a plurality of gripping elements 374 (e.g., teeth made of steel or other material having similar or higher hardness). Further, the gripping slips 372 may be hydraulically actuated or mechanically actuated to release the gripping slips 372 from a position within the liner hanger body 370 to a position that is at least partially radially protruding from the liner hanger body 370. FIG. 4 shows one gripping element (e.g., slips 372) in a radially retracted position and one gripping element in a radially protracted position merely for illustrative purposes. However, in operation, the gripping elements 372 may be held in the same retracted position or in the same protracted position. Further, specific actuation components have been omitted from FIG. 4 for clarity, as a variety of known actuation components may be used to actuate the gripping elements 372.

As a fluid is moved through the space between the rotor 310 and the stator 320, the fluid rotates the rotor 310 within the stator 320. In such manner, as fluid is pumped downhole through a stationary drill string 330 and connected downhole motor stator 320, the pumped fluid may rotate the rotor 310 relative to the stator 320 while the stator 320 may remain relatively stationary (not rotate). As the rotor 310 rotates, the transmission shaft 312 rotates with the rotor 310 and transfers the rotational torque from the rotor 310 to the attached rotatable element 360 in the rotatable liner hanger 350. Through the connection 362 between the liner 340 and rotatable element 360, the liner 340 may also rotate with the rotating rotor 310, transmission shaft 312, and rotatable element 360. When indirect connections are made between the liner 340, the rotor 310/transmission shaft 312, and rotatable element 360, the connecting components may also rotate with the liner 340, the rotating rotor 310, transmission shaft 312, and rotatable element 360.

Although one or more connecting components may be used between the downhole motor 300, the rotatable liner hanger 350, and the liner 340, the downhole motor 300, rotatable liner hanger 350, and an attachment axial end 342 of the liner 340 may be arranged proximate to each other with direct or indirect connections therebetween (e.g., having less than 40 ft between each of the downhole motor 300, the rotatable liner hanger 350, and the attachment axial end 342 of the liner 340; or having two or less tool connection joints between each of the downhole motor 300, the rotatable liner hanger 350, and the attachment axial end 342 of the liner 340). By arranging the downhole motor 300, rotatable liner hanger 350, and attachment axial end 342 of the liner 340 proximate to each other, stresses occurring during torque transfer from the downhole motor 300 to the liner 340 may be minimized.

When fluid is pumped through the downhole motor 300, the fluid may continue to flow out of the downhole motor 300 through one or more flow passages through a connected drill string component (e.g., through one or more flow passages formed through the rotatable liner hanger 350 and/or through one or more flow passages formed through a connected running tool). In some embodiments, when fluid is directed through one or more flow passages formed through a running tool and/or rotatable liner hanger, the fluid flow through the flow passages may be used, for example, in hydraulic actuation of one or more components in the running tool and/or liner hanger and may exit through the liner shoe located at the bottom of the liner to facilitate washing through the drilled hole and ease the deployment of the liner. In some embodiments, fluid may be flowed by one or more sensors on the downhole assembly (e.g., on the liner hanger, the downhole motor, or other portion of the drill string) for fluid testing. Additionally, or alternatively, the fluid being pumped through the downhole motor 300 may continue to flow out of the downhole motor 300 through one or more outlet flow passages formed through the downhole motor 300 housing, such that the fluid may exit the downhole motor 300 and return back to the surface of the well through the annular space formed between the drill string and casing.

Connections between components in the downhole assembly (e.g., between the downhole motor, running tool, and liner hanger) may include downhole releasable connection mechanisms known in the art, for example, threaded connections, J-slots, snap rings, and latching mechanisms. For example, a downhole motor may be connected to a liner running tool via a standard threaded drill pipe connection. In threaded drill pipe connections, a box end formed at an axial end of one component (e.g., either the downhole motor or running tool) may have threads formed around the interior surface of the box end, and a pin end formed at an axial end of another component (e.g., the other of the downhole motor or running tool) may have threads formed around the exterior surface of the pin end. The box end and pin end of two components may be fastened together by torqueing up the box and pin threads of the connection.

A liner running tool may be connected to the upper end of a liner via a standard rotatable/releasable mechanism that includes a torque transmitting profile in the bottom end of the running tool and matching profile inside the liner hanger, such that rotation of the running tool may transmit torque and rotate the linger hanger through the matching torque transmitting profiles. A snap ring (or other releasable latching component) may be positioned in grooves formed between the running tool and liner hanger, which holds the axial loads of the liner weight and facilitates pushing the liner in the drilled hole when the snap ring (or other latching component) is fitted within the grooves. Once the liner reaches setting depth, the snap ring may be collapsed/retracted to release from the groove inside the liner, and the running tool may be disengaged from inside the liner. The disengaging mechanism may be activated, for example, by increasing the pumping rate inside the drill string to increase a differential pressure across the running tool that activates the disengaging mechanism, or by incorporating a battery powered pump in the running tool that is activated by an RFID chip to signal downhole sensors. When the running tool is disengaged from the liner, the running tool may be pulled out of the well. In some embodiments, when the running tool is disengaged from the running torque transmitting profile in the liner, the running tool may then be used to set the liner hanger slips by engaging a secondary profile in an inner surface of the liner hanger (located axially above the running torque transmitting profile). For example, the running tool may engage a secondary profile and rotate an internal mandrill in the liner hanger, where the internal mandrill is connected to a setting cone that axially moves partially within the liner hanger slips to force the liner hanger slips radially outward and engage the casing.

Systems of the present disclosure may be used for downhole drilling and well completion methods to provide improved installment of a liner within an open borehole. For example, well formation methods may include tripping a drill string into a well, where the drill string has a downhole motor connected at a lower end of the drill string opposite the surface of the well and above a connected liner. In other words, the downhole motor may be positioned along a drill string axially between a liner and a portion of the drill string reaching the surface of the well. The liner may be connected to the downhole motor, such that the liner is operatively connected to the drill string through the downhole motor. By operatively connecting the liner to the drill string, the liner may rotate with the drill string as the drill string rotates (e.g., as a rotary system at the rig rotates the drill string from above the well surface). By providing the downhole motor along the drill string and connected to an upper end of the liner, the liner may continue to rotate even when the drill string has stopped rotating. For example, a drill pipe stand may be connected at an upper end of the drill string to elongate the drill string and send the liner farther into the well. During making the connection of the drill pipe stand to the drill string, a fluid may be continuously pumped through the drill string, and the liner may be rotated relative to the drill string using the downhole motor.

FIGS. 5-10 show examples of steps in drilling and completing a well according to methods of the present disclosure.

Figure 5:
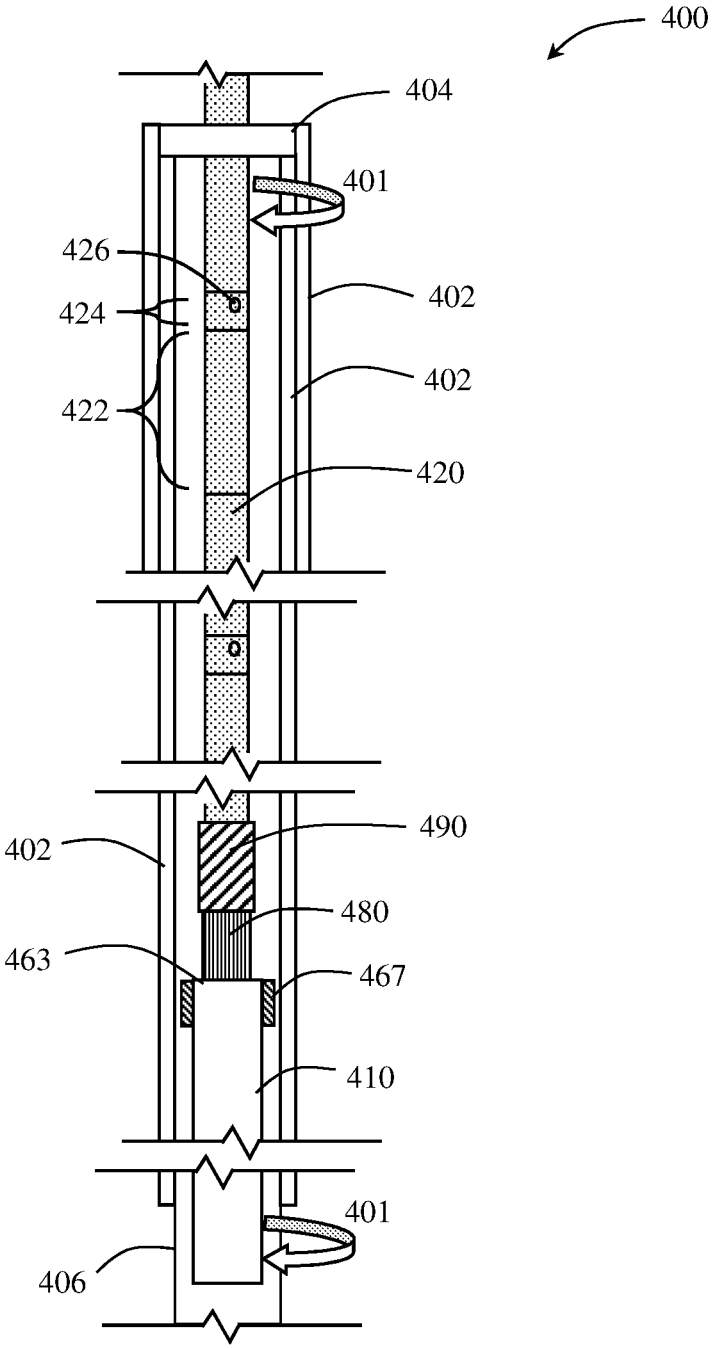
FIGS. 5-10 show schematic representations of steps in methods of lining a well according to embodiments of the present disclosure.

As shown in FIG. 5, a portion of a well 400 may be initially drilled and cased with casing 402. The casing 402 may include one or more concentric layers of casing tubing extending from the wellhead 404 to different depths through the wellbore 406 and cement holding the casing 402 in place. A liner 410 may be sent downhole to case an open bore 406 portion of the well 400 using a drill string 420. The drill string 420 may include a plurality of connected-together drill pipe joints 422 and at least one continuous circulation sub 424. A drill pipe joint 422 may range, for example, from about 30 to 40 feet long; although other joint lengths may be used. In some embodiments, two, three, or four drill pipe joints 422 may be threadedly connected together to form a drill pipe stand segment, and multiple drill pipe stands may be connected together to form the drill string 420. A continuous circulation sub 424 may be connected at an axial end of each drill pipe stand, such that when multiple drill pipe stands are assembled to form the drill string 420, the drill string may include a pattern of continuous circulation subs 424 positioned between repeating segments of multiple (e.g., 2-4) connected together drill pipe joints 422. A continuous circulation sub 424 may be a substantially tubular body having threaded connections at each opposite axial end, which correspond to and may be connected to the threaded connection ends of a drill pipe joint 422. A continuous circulation sub 424 may further include a valved side inlet 426 along the tubular body between the axial threaded connection ends. The valved side inlet 426 may include a valve that may be opened during fluid injection from a continuous circulation surface piping and may remain closed when sent downhole.

A liner 410 may be connected at a lower end of the drill string 420. The liner 420 may be connected to the drill string 420 through connections between a downhole motor 490, a liner hanger 467, and optionally, a separate running tool 480 connected between the downhole motor 490 and the liner hanger 467. For example, an upper end 463 of the liner 410 may have a liner hanger 467 directly connected to (and adjacent) an axial end of a running tool 480, an opposite axial end of the running tool 480 may be directly connected to (and adjacent) an axial end of the downhole motor 490, and an opposite axial end of the downhole motor 490 may be directly connected to (and adjacent) a drill pipe 422 of the drill string 420. In some embodiments, one or more connecting elements (e.g., a connecting collar) may be used to make a connection between the drill string 420 and the downhole motor 490, between the downhole motor 490 and running tool 480, and/or between the running tool 480 and the liner hanger 467.

As the liner 410 is sent downhole, the drill string 420 may be rotated 401 (e.g., using a top drive or Kelly system at the rig), which rotates 401 the connected liner 410. Rotation of the liner 410 as it is sent downhole may help prevent debris build-up and sticking of the liner 410 against the wall of the well 400. However, as the drill string 420 is lowered into the well 400, more drill pipe needs to be added to the drill string 420. When a connection is made to the drill string 420 at the rig surface, rotation of the drill string 420 at the rig surface is stopped during making the connection.

Figure 6:
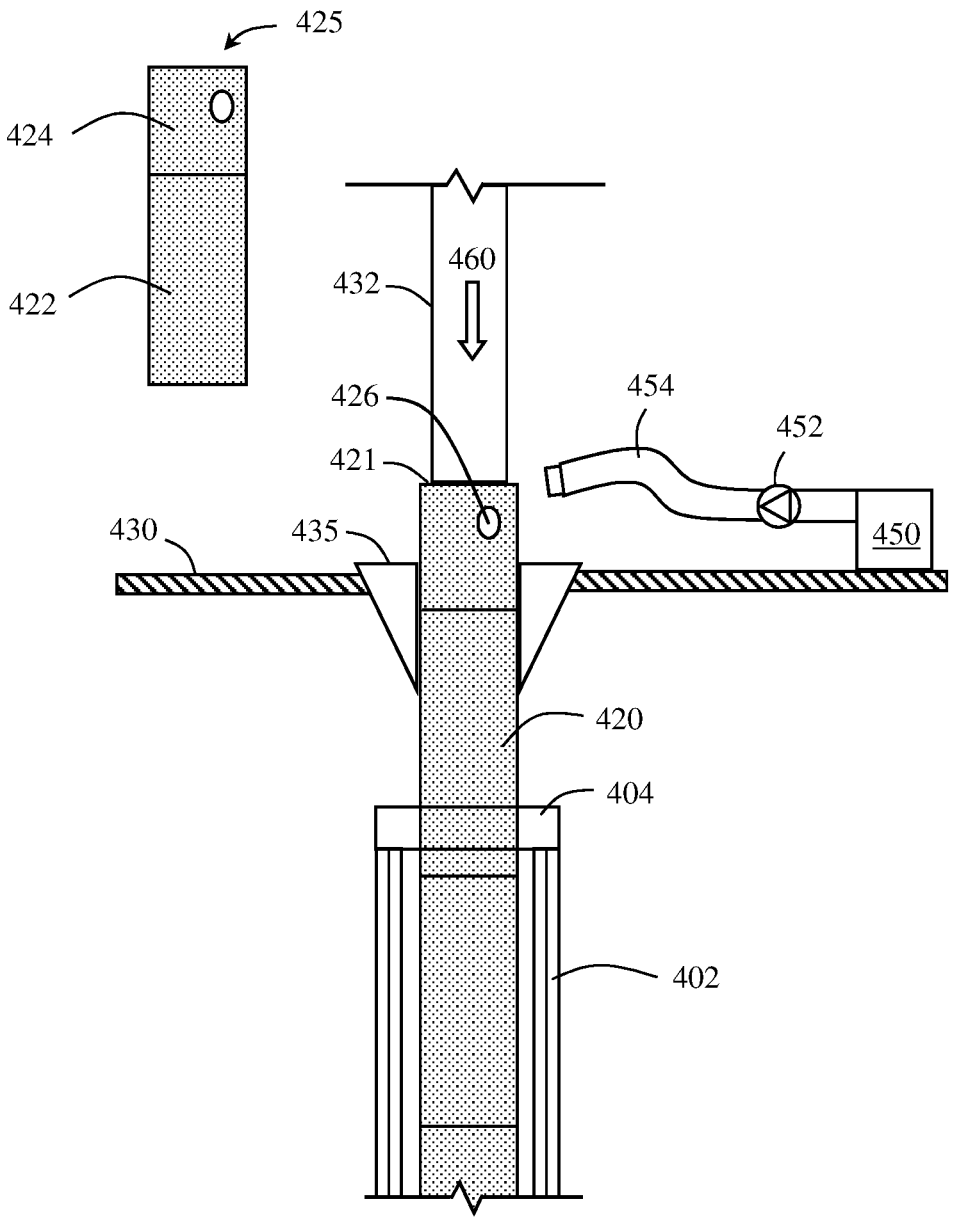

As shown in FIG. 6, when it is time to add a length of drill pipe (e.g., drill pipe joint or stand) to the drill string 420, the top drive or rotary system at the rig 430 is stopped to stop rotation of the drill string 420. Fluid 460 may continue to be pumped through a mud hose 432 to the top end 421 of the drill string 420 while the slips 435 are set around the drill string 420. The top end 421 of the drill string 420 may be a continuous circulation sub 424 having a valved side inlet 426. When slips 435 are holding the drill string 420, fluid injection may be switched from being pumped through the top end 421 to being pumped through the valved side inlet 426 of continuous circulation sub 424. Fluid being pumped through the valved side inlet 426 of the continuous circulation sub 424 and into the drill string 420 may be supplied through continuous circulation surface piping 454. The fluid may be pumped from a fluid source 450 (e.g., mud pit) using one or more continuous circulation pumps 452.

Figure 7:
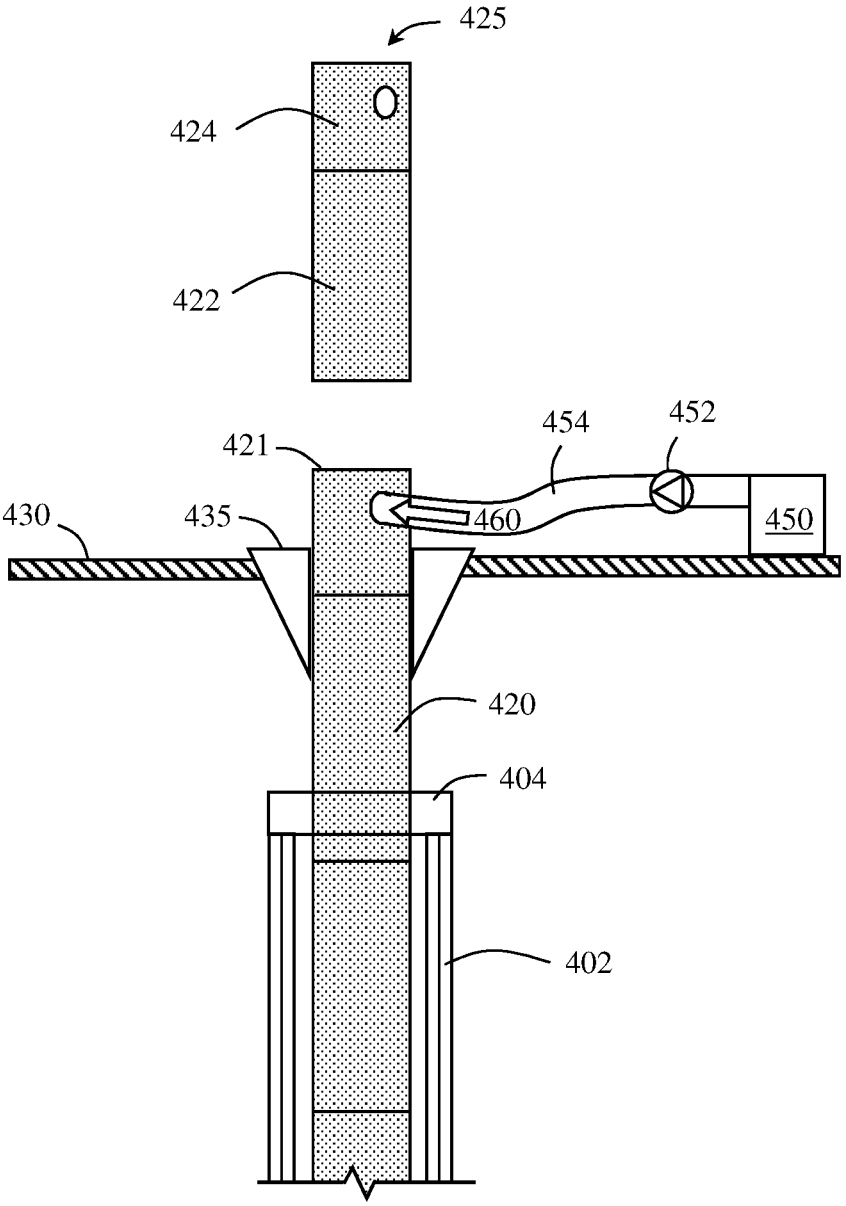

As shown in FIG. 7, while fluid 460 is being pumped from the continuous circulation system (e.g., including a fluid source 450, pump 452, and continuous circulation surface piping 454) through a side inlet into the drill string 420, fluid injection from the mud hose 432 into the top end 421 may be stopped, and the mud hose 432 may be moved to allow the next drill pipe 425 to be held over the top end 421 of the drill string 420 (e.g., using a drawworks system on the rig 430 or robotic arm(s) on the rig 430) and connected to the drill string 420. The next drill pipe 425 may also include a continuous circulation sub 424 at the top end of the next drill pipe 425, such that once the next drill pipe 425 is connected to and part of the drill string 420, the top end 421 of the drill string 420 will again have a continuous circulation sub 424 provided for use in making a subsequent connection.

Figure 8:
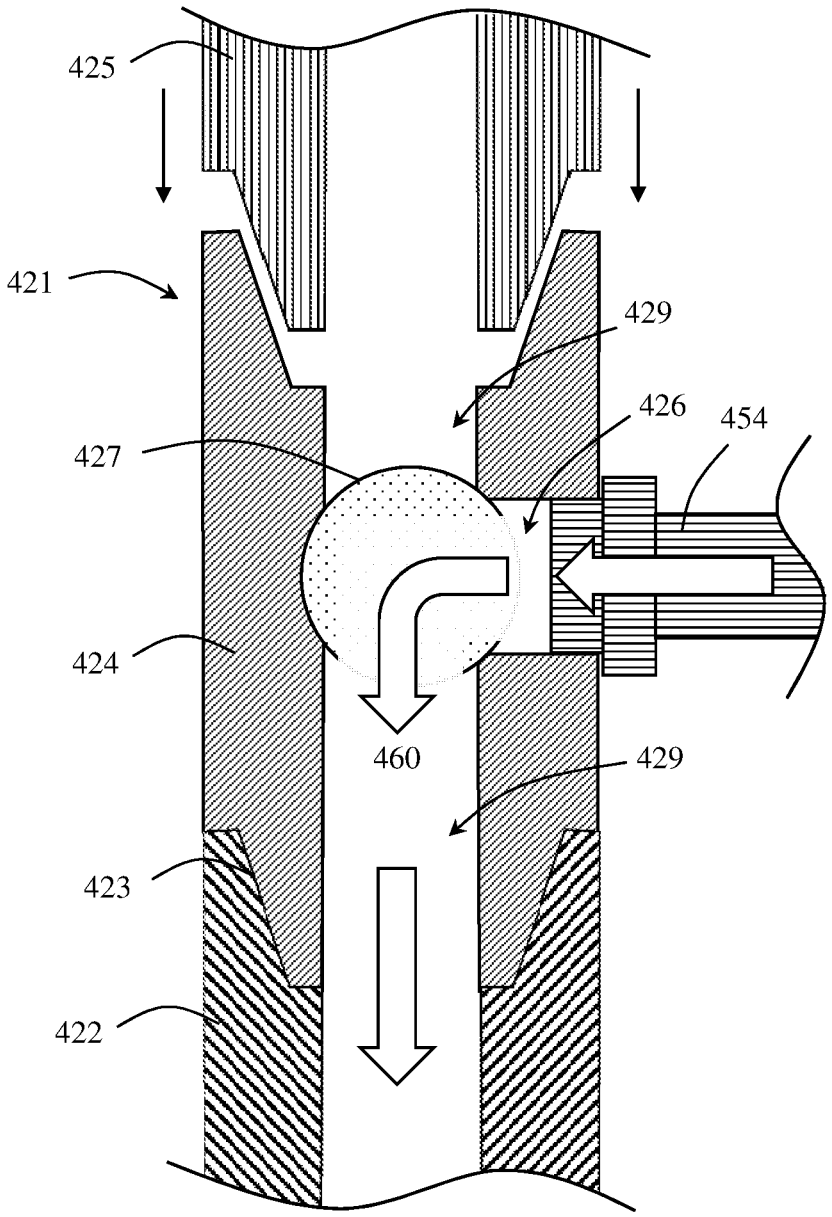

An example of continuous fluid circulation through a continuous circulation sub 424 is shown in FIG. 8. The continuous circulation sub is attached to a drill pipe 422 at a threaded connection 423 and forms a top end 421 of the drill string 420. The continuous circulation sub 424 has a side inlet 426 formed through its wall that is in fluid communication with a main fluid passage 429 via a valve 427. The valve 427 may be a three way valve such as, for example, a ball valve or a flapper valve. When the valve 427 is in a first position, fluid 460 may be pumped through the main fluid passage 429 from a mud hose 432 (as shown in FIG. 6) to the rest of the drill string 420, while fluid flow 460 is blocked through the side inlet 426. When the valve 427 is in a second position, fluid 460 may be pumped into the side inlet 426, through the valve 427, through the main fluid passage 429, and into the rest of the drill string 420, while fluid flow from above the top end 421 is blocked. The valve 427 may be switched to the second position when a continuous circulation surface piping 454 is inserted into the side inlet 426 and applies fluid pressure to switch the valve 427 position. In some embodiments, the valve position may be switched using an electronic control.

When a continuous circulation surface piping 454 nozzle is inserted in the side inlet 426 (or in some continuous circulation systems, the continuous circulation piping may enclose the side inlet) to deliver fluid being pumped from a fluid source (e.g., mud pit) into the continuous circulation sub 424, the fluid flow 460 from the continuous circulation surface piping 454 may activate the valve 427 to switch positions, thereby blocking fluid flow from above the top end 421 of the drill string 420 and allowing fluid flow from the side inlet 426.

Figure 9:
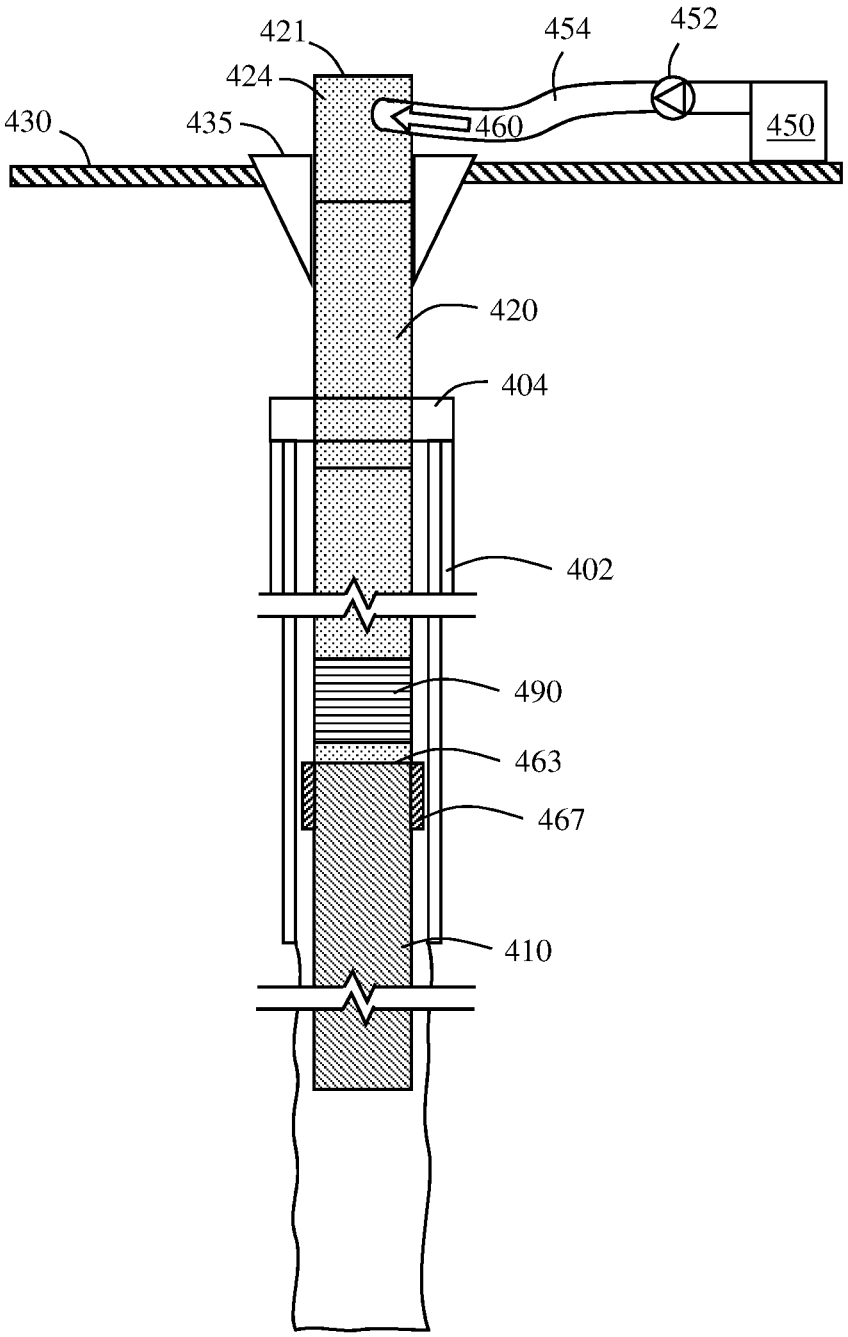

As shown in FIG. 9, while the drill string 420 is held in slips 435 and drilling fluid is pumped in through a continuous circulation sub 424 during making a connection to the drill string 420, the downhole motor 490 may be operated using the continuous fluid flow. The downhole motor 490 may be disposed along the drill string 420 proximate to and connected to an upper end 463 of the liner 410, such that operation of the downhole motor 490 from the continuous fluid flow may rotate the connected liner 410 even while the drill string 420 is held in the slips 435.

Figure 10:
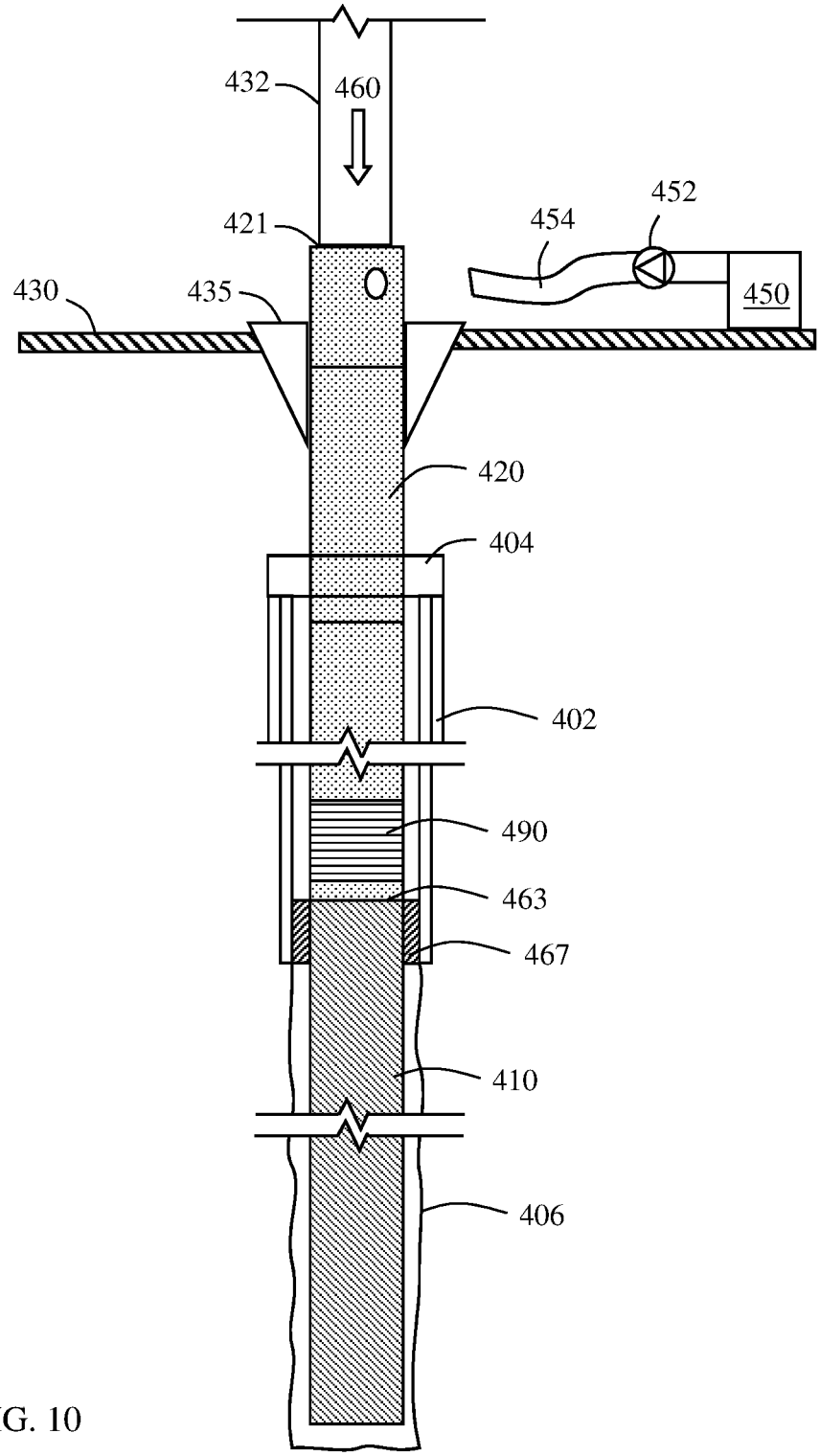

As shown in FIG. 10, subsequent connections to the drill string 420 may be made in the same manner as described above until the liner 410 reaches a lower end of a previously installed casing 402. When a liner hanger 467 disposed at the upper end 463 of the liner 410 is aligned with the lower end of the previously installed casing 402, the liner hanger 467 may be activated to expand radially outward from the liner 410 and grip the casing 402.

Drilling fluid 460 may be continuously circulated through the drill string 420 and connected liner 410, either from the continuous circulation system or the mud hose 432 connected at the top end 421 of the drill string 420, to operate the downhole motor 490 (and rotate the connected liner 410) as well as clear debris downhole and maintain wellbore pressure.

After the liner 410 is attached to the casing 402 using the liner hanger 467, cement may be pumped downhole, through the interior of the liner 410 and around the exterior of the liner 410 to cement the liner 410 in place within the wellbore 406. In some embodiments, the liner hanger 467 may be a rotatable liner hanger that allows rotation of the liner 410 while the liner 410 is attached to the casing 402. As cement is pumped through the drill string 420, through the liner 410, and around an exterior of the liner 410, the liner 410 may be rotated to aid in spreading the cement uniformly around the liner 410. After cementing the liner 410 in place, the drill string 420 may be disconnected from the liner 410 (e.g., by disconnecting the downhole motor 490 from the liner 410).

According to embodiments of the present disclosure, a liner may be installed during drilling an open borehole in which the liner is to be installed (where a bottom hole assembly or a drilling liner shoe with PDC inserts/cutting elements may be attached at a lower end of the liner to drill the borehole as the liner is lowered in the well), or a liner may be installed after an open borehole has been drilled (where the liner may not have a bottom hole assembly attached at its lower end).

For example, in some embodiments, a bottom hole assembly may be connected to an axial end of the liner opposite from the downhole motor. The connected bottom hole assembly may be used to drill the wellbore farther as the liner is descended through the well. In such manner, the bottom hole assembly may be used to drill the portion of the wellbore in which the liner is to be installed. In some embodiments, a bottom hole assembly and/or a reamer may be provided at an axial end of the liner to ream the wellbore, to assure the wellbore has a large enough diameter for the liner to fit within.

Figure 11:
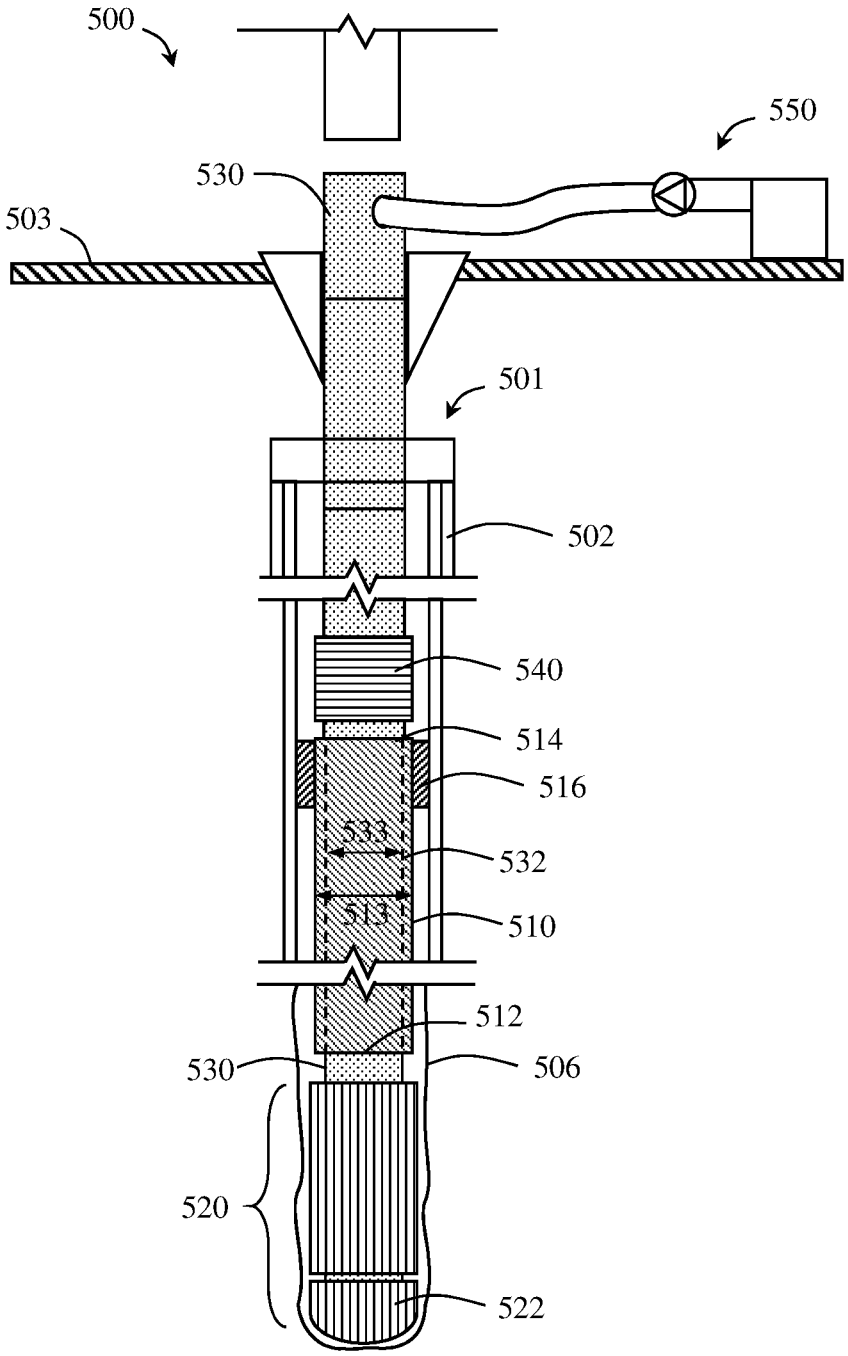
FIG. 11 shows a system for forming and lining a well according to embodiments of the present disclosure.

FIG. 11 shows an example of a system 500 for lining a portion of a well 501 that includes a drill string 530 having a downhole motor 540, a liner 510, and a bottom hole assembly 520. The bottom hole assembly 520 is positioned proximate to a first axial end 512 of the liner 510, where the first axial end 512 of the liner 510 is the axial end farthest from the surface of the well 501. The liner 510 is connected to and sent downhole on a drill string 530. The liner 510 may be sent farther into the well 501 by making drill string connections, as described herein, to lengthen the drill string 530. The downhole motor 540 may be positioned along the drill string 530 proximate to and operably connected to a second axial end 514 of the liner 510, opposite the first axial end 512, such that the downhole motor 540 may rotate the liner 510.

When sending the liner 510 downhole to be installed, the drill string 530 may extend from the surface of the well 501, into the well 501, and through the liner 510 (from the second axial end 514 of the liner 510 to the first axial end 512 of the liner) to the connected bottom hole assembly 520. The portion 532 of the drill string 530 extending through the liner 510 may have an outer diameter 533 that is less than an inner diameter 513 of the liner 510. A first connection between the liner 510 and the drill string 530 may be at the first axial end 512 of the liner 510, for example, between the first axial end 512 of the liner 510 and the bottom hole assembly 520 or between the first axial end 512 and a connecting element between the liner 510 and bottom hole assembly 520. A second connection between the liner 510 and the drill string 530 may be at the second axial 514 of the liner 510, for example, between a liner hanger 516 at the second axial end 514 of the liner 510 and a downhole motor 540 positioned along the drill string 530 or between the liner hanger 516 and a connecting element between the liner and downhole motor 540.

The bottom hole assembly 520 may include, for example, a drill bit 522, one or more stabilizers, one or more drill collars, and one or more reamers. In some embodiments, a second downhole motor and/or steering equipment may be connected to or part of the bottom hole assembly 520 (between a drill bit 522 in the bottom hole assembly 520 and the first axial end 512 of the liner 510), which may be used to help the bottom hole assembly 520 drill the wellbore 506 as the liner 510 follows. A first connection between a first axial end 512 of the liner 510 and the drill string 530 may be an indirect connection, for example, where the first axial end 512 of the liner 510 is connected to the bottom hole assembly 520, and the bottom hole assembly 520 is connected to the drill string 530. In some embodiments, when the first axial end 512 of the liner 510 is connected to a bottom hole assembly 520, rotation of the liner 510 may also rotate the connected bottom hole assembly 520. In other embodiments, a connection between the first axial end 512 of the liner 510 and the bottom hole assembly 520 (either direct connection or indirect connection between the liner and a component of the drill string between the liner and bottom hole assembly) may include a rotatable connection that allows rotation of the liner 510 independent of the bottom hole assembly 520 and vice versa.

As an example of a method for drilling or reaming a portion of a wellbore 506 in the same trip as installing a liner 510, the bottom hole assembly 520 may be provided at the bottom of the drill string 530 and may be proximate to the first axial end 512 of the liner 510. The drill string 530 may extend from the connected bottom hole assembly 520 through the interior of the liner 510 to the downhole motor 540 connected at the second axial end 514 of the liner 510. The drill string 530 may further extend from the downhole motor 540 to the surface of the well 501, where drill pipe may be added to the drill string 530 to lengthen the drill string 530. As the drill string 530 is moved through the well 501, the drill string 530 is rotated (e.g., using a Kelly or top drive rotary system), which may also rotate the connected bottom hole assembly 520 and connected liner 510. Rotation of the connected bottom hole assembly 520 and the weight on a bit 522 in the bottom hole assembly 520 may operate the bottom hole assembly to drill through a formation and create additional wellbore length. Once the wellbore 506 has been drilled to a desired length, the connected liner 510 may be set in the drilled wellbore 506.

During making a connection to add drill pipe to the drill string 530, rotation of the drill string 530 from the rig 503 is stopped, and drilling fluid may be flowed through the drill string 530 using a continuous circulation system 550. The fluid flow through the drill string 530 may operate the downhole motor 540, such that the downhole motor 540 may rotate the connected liner 510 even while the drill string 530 is not being rotated from the rig. The bottom hole assembly 520 may also be indirectly but operably connected to the downhole motor 540 such that the bottom hole assembly 520 may rotate with the connected liner 510. Alternatively, the bottom hole assembly 520 may independently connected to the drill string 530 (and not operably connected to the downhole motor 540) such that operation of the downhole motor 540 and its rotation of the liner 510 does not rotate the bottom hole assembly 520. In some embodiments, a second downhole motor is connected in an axial position between the bottom hole assembly 520 and the liner 510 to independently rotate the bottom hole assembly 520.

When the bottom hole assembly 520 has drilled a wellbore 506 to length for installation of the liner 510, the liner 510 may be attached to the lowermost end of previously installed casing 502 using the liner hanger 516. Cement may then be sent down the drill string 530 and around the exterior of the liner 510 (within the annulus between the liner 510 and wellbore 506) to cement the liner 510 in place.

The first and second connections between the liner 510 and drill string 530 may be disconnectable connections. For example, the first and second connections between the liner 510 and drill string 530 may include one or more threaded connections, J-slots and/or locking mechanisms that may be disconnected by, for example, dropping a ball through the drill string to unlock a locking mechanism, maneuvering the drill string 530 in a manner to unscrew and threaded connection and/or releasing a lock pin from a J-slot. In some embodiments, a running tool may be provided along the drill string 530 proximate to and connected to the first and/or second axial ends of the liner 510 to provide the disconnectable first and/or second connections between the liner 510 and drill string 530.

In some embodiments, when the liner 510 is to be positioned in the end of the well 501 and no further drilling is to take place in the well after the liner 510 is installed, a first connection between the liner 510 and drill string 530 may be disconnected by disconnecting the bottom hole assembly 520 from the drill string 530 and/or first axial end 512 of the liner 510 (e.g., by dropping a ball to release a locking mechanism, using one or more valve actuations, or other releasable connections). Once the bottom hole assembly 520 is disconnected from the drill string 530, the bottom hole assembly 520 may be left at the bottom 502 of the well 501 while the remaining drill string 530 is pulled back up to the surface of the well 501. Because the portion of the drill string 530 extending through the liner 510 has an outer diameter less than the inner diameter of the liner 510, the drill string 530 may be pulled through the liner 510 in a direction back toward the surface of the well 501 while the liner 510 may remain in position downhole.

Systems and methods disclosed herein may be used with vertical or directional drilling operations. For example, a liner may be sent downhole to line a horizontal section of a well and/or a vertical section of the well.

Advantageously, methods and systems of the present disclosure may be used to avoid differential sticking of a liner as it is being installed. In conventional methods of adding sections of drill pipe to a drill string (which holds a connected liner as it is being installed), the drill string is held stationary (not rotated) as the new drill pipe is added. While stationary, downhole debris may settle and build up and/or downhole equipment may settle and stick against the well wall. By continuously rotating the liner as it is sent downhole to be installed, including rotating the liner while drill string connections are being made, the liner may be inhibited from getting stuck along the well wall.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A system for drilling a well, comprising:
- a gripping unit provided at a rig above a surface of the well for holding an upper end of a drill string in the well;
- a liner releasably connected to the drill string; and
- a downhole motor installed on the drill string in an axial position between the surface of the well and the liner, the downhole motor comprising:
  - a stator connected to the drill string; and
  - a rotor rotatably retained within the stator and operatively connected to an axial end of the liner closest to the surface of the well.

2. The system of claim 1, further comprising:
- at least one mud pump; and
- continuous circulation surface piping provided at the rig, the continuous circulation surface piping fluidly connected to the at least one mud pump.

3. The system of claim 1, wherein the downhole motor is a positive displacement motor.

4. The system of claim 1, further comprising a liner hanger installed along the liner proximate to the downhole motor.

5. The system of claim 4, wherein the liner hanger comprises:
- at least one gripping slip provided around a liner hanger body; and
- a rotatable element connected to the liner;
- wherein the rotatable element is rotatable relative to the liner hanger body.

6. The system of claim 1, wherein the upper end of the drill string comprises a continuous circulation sub.

7. The system of claim 1, further comprising a riser extending from the rig to the surface of the well, wherein the drill string extends through the riser and into the well.

8. The system of claim 1, further comprising a bottom hole assembly connected at a lower end of the drill string, wherein a portion of the drill string extends through the liner to the connected bottom hole assembly.

9. A method, comprising:
- tripping a drill string into a well, the drill string comprising:
  - a downhole motor connected along the drill string; and
  - a liner connected to the downhole motor, such that the liner is operatively connected to the drill string through the downhole motor;
- connecting a drill pipe stand at an upper end of the drill string;
- rotating the liner relative to the drill string using the downhole motor during the connecting; and
- continuously pumping a fluid through the drill string during the connecting.

10. The method of claim 9, wherein the drill string comprises a plurality of connected-together drill pipe and at least one continuous circulation sub.

11. The method of claim 10, further comprising connecting a continuous circulation piping to the continuous circulation sub to continuously pump the fluid through the drill string, wherein the continuous circulation piping is fluidly connected to a fluid source and at least one pump.

12. The method of claim 9, wherein the continuously pumped fluid is used to operate the downhole motor.

13. The method of claim 9, further comprising:
- attaching a liner hanger disposed at an upper end of the liner to a lower end of a casing installed in the well; and
- disconnecting the liner from the drill string.

14. The method of claim 13, wherein the liner hanger is a rotatable liner hanger, the method further comprising:
- pumping cement through the drill string, through the liner, and around an exterior of the liner; and
- rotating the liner using the rotatable liner hanger as the cement is pumped through the liner.

15. The method of claim 9, wherein a bottom hole assembly is connected at a lower end of the drill string, the method further comprising rotating the drill string after connecting the drill pipe stand to the upper end of the drill string to rotate the bottom hole assembly.

16. A system, comprising:
- a drill string comprising a plurality of connected-together drill pipe and at least one continuous circulation sub;
- a liner disposed at a lower end of the drill string;
- a downhole motor operatively connecting the liner to the drill string; and
- continuous circulation piping fluidly connected to a fluid source and at least one pump.

17. The system of claim 16, further comprising a liner hanger attached to the liner proximate the downhole motor.

18. The system of claim 17, wherein the liner hanger is a rotatable liner hanger.

19. The system of claim 16, wherein the downhole motor is operatively connected to the liner through a running tool, the running tool detachably connected to a top end of the liner.

20. The system of claim 16, further comprising at least one drill pipe stand, each drill pipe stand comprising an additional continuous circulation sub.

21. A system for drilling a well, comprising:

a drill string having an upper end and a lower end opposite the upper end;

a downhole motor installed on the drill string in an axial position between the upper end and the lower end, wherein the downhole motor comprises:

a stator connected to the drill string; and a rotor rotatably retained within the stator; and a liner releasably connected to the drill string, wherein an attachment axial end of the liner is operatively connected to the rotor of the downhole motor.

22. The system of claim 21, wherein a rotatable liner hanger is positioned at the attachment axial end of the liner, and wherein the rotatable liner hanger comprises:

a liner hanger body directly or indirectly connected to the stator; and a rotatable element rotatably retained in the liner hanger body, wherein the rotatable element is directly or indirectly connected to the rotor and the liner.

* * * * *